US007703499B2

(12) United States Patent
Tait et al.

(10) Patent No.: US 7,703,499 B2
(45) Date of Patent: Apr. 27, 2010

(54) PORTABLE CURTAIN RETRACTION DEVICE AND SYSTEM

(75) Inventors: Michael Tait, Lititz, PA (US); James Fairorth, Lancaster, PA (US); Adam Davis, Lancaster, PA (US)

(73) Assignee: Tait Towers, Inc., Lititz, PA (US)

( * ) Notice: Subject to any disclaimer, the term of this patent is extended or adjusted under 35 U.S.C. 154(b) by 418 days.

(21) Appl. No.: 11/677,804

(22) Filed: Feb. 22, 2007

(65) Prior Publication Data

US 2008/0203211 A1 Aug. 28, 2008

(51) Int. Cl.
*A47H 5/02* (2006.01)

(52) U.S. Cl. ..... 160/84.01; 160/84.02

(58) Field of Classification Search ..... 160/84.01, 160/84.02, 84.04, 340, 262, 170, 171, 352, 160/331; 135/902
See application file for complete search history.

(56) References Cited

U.S. PATENT DOCUMENTS

| | | | | |
|---|---|---|---|---|
| 516,018 | A * | 3/1894 | Lauer | 160/262 |
| 1,084,781 | A | 1/1914 | Behrle | |
| 1,407,248 | A * | 2/1922 | Brown | 160/84.01 |
| 1,651,985 | A * | 12/1927 | Allen | 160/331 |
| 1,894,833 | A | 1/1933 | Ruby et al. | |
| 1,900,677 | A * | 3/1933 | Weidhaas et al. | 160/10 |
| 2,002,268 | A * | 5/1935 | Lassen et al. | 160/331 |
| 2,420,301 | A * | 5/1947 | Cusumano | 160/170 |
| 2,676,654 | A * | 4/1954 | Vallen | 160/331 |
| 3,075,805 | A * | 1/1963 | Golde et al. | 296/98 |
| 3,092,174 | A * | 6/1963 | Winn | 160/262 |
| 3,141,497 | A | 7/1964 | Griesser | |
| 3,310,099 | A | 3/1967 | Hunter et al. | |
| 4,062,519 | A | 12/1977 | Jacobs | |
| 4,828,003 | A | 5/1989 | Kraeutler | |
| 4,850,415 | A * | 7/1989 | Rometsch | 160/84.02 |
| 4,919,186 | A * | 4/1990 | Uecker et al. | 160/321 |
| 5,029,629 | A | 7/1991 | Cheng-Pei | |
| 5,092,382 | A * | 3/1992 | Fluckiger | 160/84.01 |
| 5,430,980 | A * | 7/1995 | Ferrier | 52/63 |
| 6,283,192 | B1 * | 9/2001 | Toti | 160/170 |
| 6,736,184 | B2 | 5/2004 | Eaton | |
| 7,128,122 | B2 * | 10/2006 | Lin | 160/168.1 P |
| 7,287,570 | B2 * | 10/2007 | Strand | 160/171 |

FOREIGN PATENT DOCUMENTS

| | | |
|---|---|---|
| GB | 190726231 | 11/1908 |
| JP | 05-049531 | 3/1993 |
| JP | 07-265553 | 10/1995 |
| JP | 08-140826 | 4/1996 |
| JP | 2002-078603 | 3/2002 |

* cited by examiner

*Primary Examiner*—David Purol
(74) *Attorney, Agent, or Firm*—McNees Wallace & Nurick, z1LLC

(57) ABSTRACT

A portable barrier retraction device and system for retracting and deploying barriers, such as theatrical curtains. The portable barrier retraction device for retracting and deploying barriers, such as theatrical curtains. The device includes a rotatable shaft in rotational communication with a first drum. The device further includes a detachable rotatable second drum rotational communication with the first drum. The second drum further including at least one spool configured to retract or deploy at least one line in response to rotation of the second drum.

20 Claims, 4 Drawing Sheets

PORTABLE CURTAIN RETRACTION DEVICE AND SYSTEM

FIELD OF THE INVENTION

The present invention is directed to portable retraction devices. In particular, the present invention is directed to a portable retraction device and system for theatrical barriers.

BACKGROUND OF THE INVENTION

In the production of many theatrical events, including concerts and public events, barriers or curtains are utilized to provide particular visual effects. For example, an opaque curtain may be utilized prior to the performance to conceal areas from view, while providing a decorative surface for viewing by the audience. Other visual effects may also be provided wherein, for example, transparent or semi-transparent material may be utilized to create various visual effects by front-lighting, back-lighting or by projecting images thereon. These barriers are typically retractable, partially or fully out of view by the audience and/or may be retracted or drawn in a decorative festoon pattern, such as in an Austrian-type or French-type curtain.

The retraction systems for theatrical barriers have typically included manual drawing of strings or cables from a central location, typically at one of the sides of the curtain. Some known systems have utilized motors to provide the drawing of the strings or cables. These known systems suffer from the drawback that they are not sufficiently portable, they do not provide flexibility in measuring the lengths of the strings drawing the curtain, resulting in an uneven presentation, and/or they are cumbersome or time-consuming to erect.

What is needed is a portable system that requires little time for assembly and disassembly, and allows the lines to be individually sized to facilitate easy adjustment.

SUMMARY OF THE INVENTION

One aspect of the invention includes a portable barrier retraction device for retracting and deploying barriers, such as theatrical curtains. The device includes a rotatable shaft in rotational communication with a first drum. The device further includes a detachable rotatable second drum in rotational communication with the first drum. The second drum further including at least one spool configured to retract or deploy at least one line in response to rotation of the second drum.

Another aspect of the present invention includes a portable barrier retraction system including a barrier, such as a theatrical curtain, having at least one line disposed adjacent thereto. The device includes a rotatable shaft in rotational communication with a first drum. The device further includes a detachable rotatable second drum in rotational communication with the first drum. The second drum further includes at least one spool that retracts or deploys a line in response to rotation of the second drum. The system further includes a support frame into which the first drum and second drum are independently mounted.

An advantage of an embodiment of the present invention is that the system of the present invention is portable and allows sufficient disassembly of the components to permit transport over land, sea or by air.

Another advantage of an embodiment of the present invention is that the detachable components, including the drum for drawing in and deploying the lines and the barrier, are easily and quickly replaceable in the event of malfunction or damage.

Still another advantage of an embodiment of the present invention is that the detachable components, including the drum for drawing in and deploying the lines and the barrier, are easily and quickly replaceable in the event of malfunction or damage.

Still another advantage of an embodiment of the present invention is that the detachable drums for drawing in and deploying the line are interchangeable and permit easier manufacture and configuration of components in systems having a plurality of barrier retraction devices.

Still another advantage of an embodiment of the present invention is that the rotatable drums are disengagable from the driving mechanism, permitting independent lengthening or shortening of the lines utilized to deploy the barrier.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
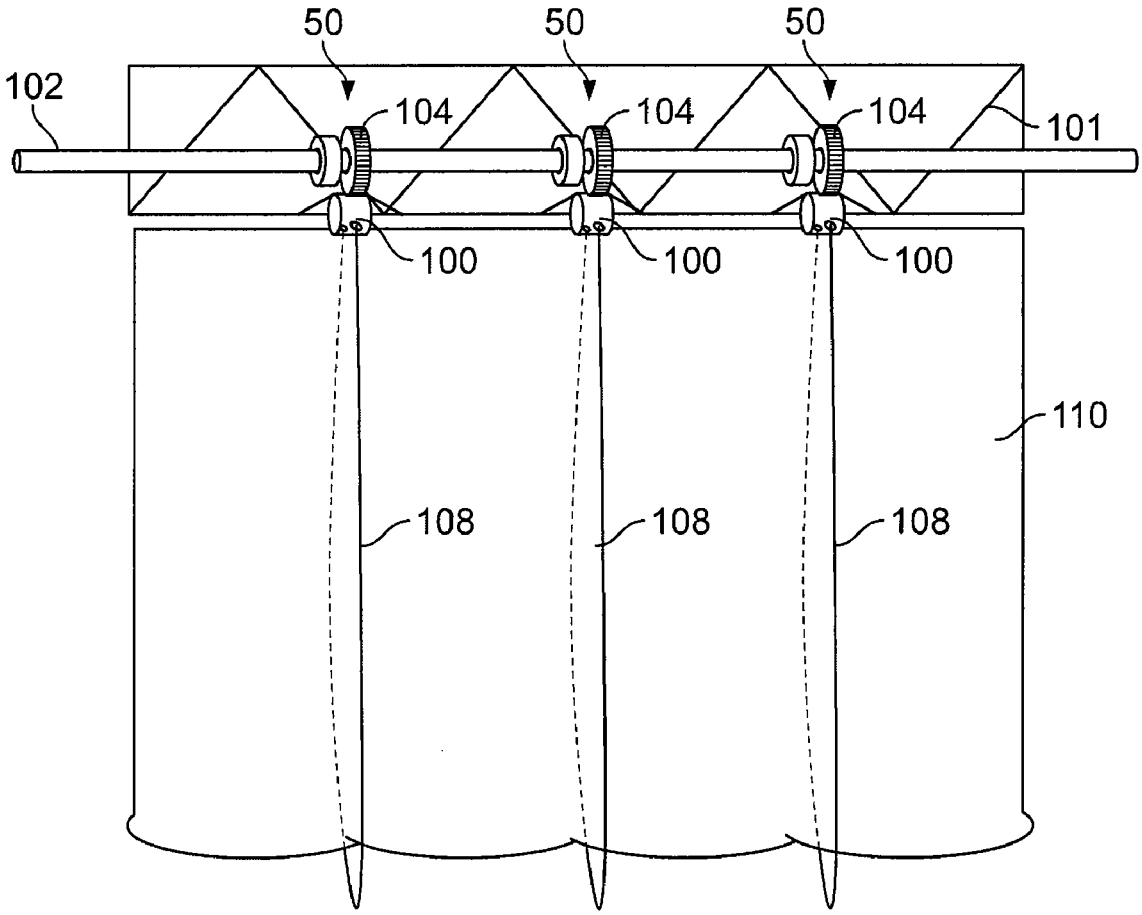
FIG. 1 shows a perspective elevational view of a barrier retraction system according to an embodiment of the present invention.

FIG. 1 shows a portable barrier retraction system that includes a portable barrier retraction device 50 mounted in a support frame 101 having a deployed soft-goods or barrier 110, shown as an Austrian-type curtain. Barrier 110 is preferably soft-goods, such as a curtain, fabric, sheet, tarp or screen, or other retractable barrier material that provides the desired visual effect. For example, barrier 110 may form a scalloped or festooned appearance along one or more edges of the barrier 110 while being retracted and preferably maintains the festooned appearance in the retracted barrier 110. The festooning may be provided by drawing lines 108 into a detachable second drum 100 resulting in a shorted line 108 around or attached to barrier 110, thereby drawing the barrier 110 upward with respect to the direction of gravity. Likewise, a retracted barrier 110 may be deployed, wherein line 108 is lengthened and barrier 110 is allowed to extend downward, preferably assisted by force of gravity. Line 108 may be any suitable flexible elongated device or material including, but not limited to, rope, wire, tape, fabric, braid or cord. In addition, the barrier 110 may be attachable to the second drum 100 by any suitable attachment device. The detachable second drum 100 is detachable in that the component may be detached from the support frame 101 for individual storage and transportation. The barrier 110 is preferably sufficiently detachable from second drum 100 to permit removal, repair and/or replacement of barrier 110 and/or second drum 100.

Figure 2:
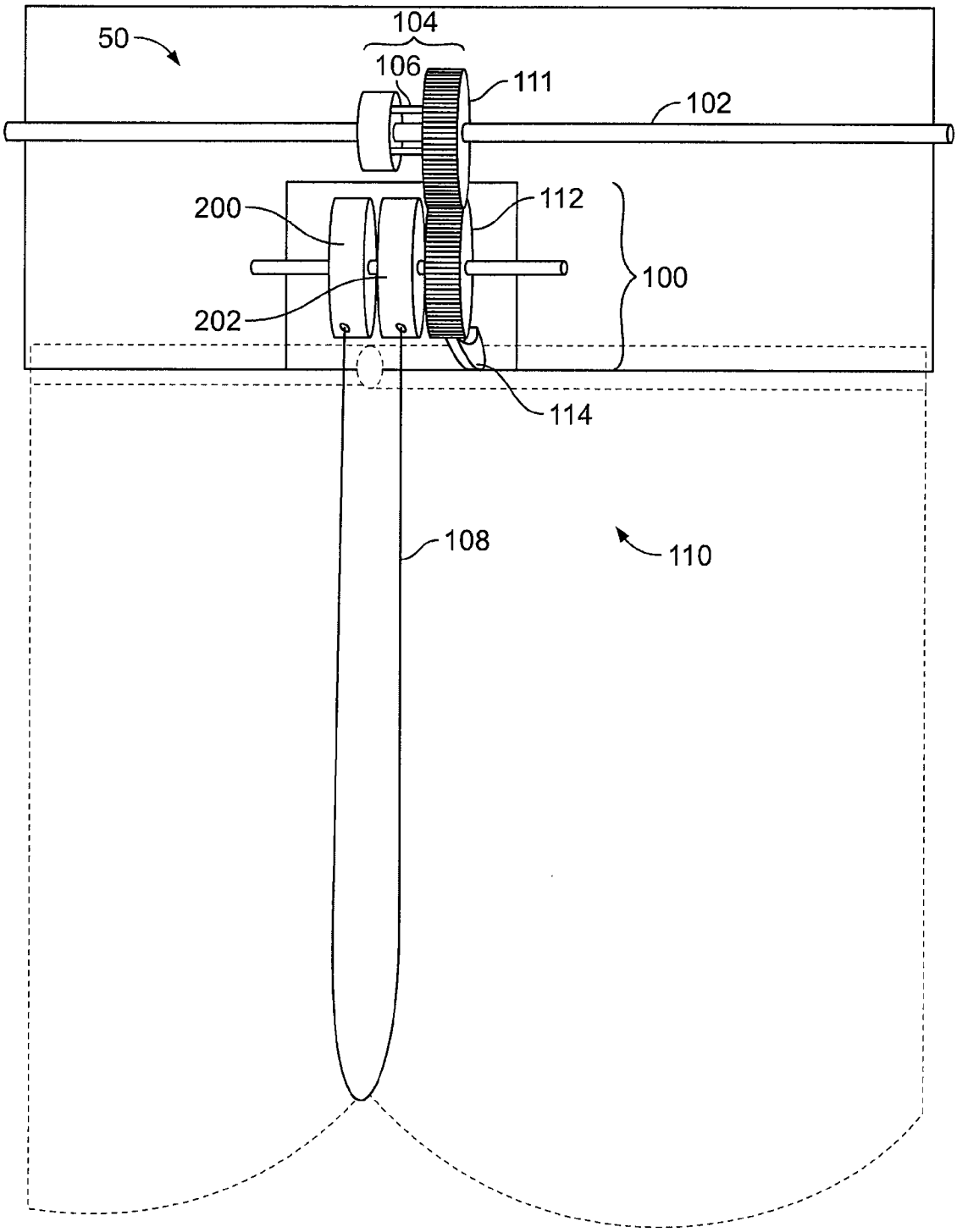
FIG. 2 shows an enlarged view of a barrier retraction device of a barrier retraction system according to the embodiment shown in FIG. 1.

As shown in FIG. 1, portable barrier retraction device 50 includes first drum 104 and detachable second drum 100. The second drum 100 is in rotational communication with first drum 104. Rotational communication, as utilized herein, includes any manner in which rotation of the first drum 100 may be imparted to the second drum 104, either directly or indirectly. Suitable arrangement providing rotation communication may include geared arrangements, drive belts, direct frictional contact, or any other combination of devices that transfer rotation of first drum 104 to second drum 100. It is to be understood that there is no fixed ratio between rotation of first drum 104 and second drum 100. In one embodiment, detachable second drum 100 as shown in FIG. 2, includes a geared arrangement, shown as second gear 112, in FIG. 2, which is connectable to a drive shaft 102 through a first drum 104 having first gear 111 (see FIG. 2), wherein rotation of drive shaft 102 imparts rotation to first drum 100 via gearing to deploy or retract line 108. Drive shaft 102 may be rotated by a motor or other device capable of rotating drive shaft 102. While the above has been described as retracting upward and deploying downward, the retraction device according to the present invention may retract or deploy in any direction and/or orientation.

In one embodiment of the present invention, the primary drive shaft 102 is connected to a plurality of barrier retraction devices 50, which are simultaneously rotated and substantially the same rotational velocity. Coordination of a plurality of barrier retraction devices 50 desirably permits the retraction of lines 108 and the barrier 110 at a substantially constant rate. The first drum 104 and second drum 100 are independently mounted in a support frame 101. First drum 104 and second drum are preferably independently mounted to allow detachment of second drum 100. In addition, independent mounting of the first drum 104 and second drum 100 permit the interchangability of the components across the system. For example, damaged second drums 100 may be quickly and easily replaced with an identical second drum 100. The support frame 101 preferably includes beams or tubular supports for mounting the first drum 104, second drum 100 and the drive shaft 102.

FIG. 2 shows an enlarged view of barrier retraction device 50, including first drum 100 in a geared arrangment with drive shaft 102 through first drum 104. The first drum 104 and the clutch 106 are rotatably attached to the drive shaft 102. First drum 104 is disengagable from the drive shaft 102 using clutch 106. Clutch 106 may be any mechanical arrangement, such as retractable connecting pins, retractable engaging surface features or disengageable frictional contact, that selectively impart rotation from the drive shaft 102 to the first drum 104. It is to be understood that electrical, electro-mechanical, hydro-mechanical or other arrangement that provide similar selective rotation between drive shaft 102 to first drum 104 are also contemplated. Disengagement of clutch 106 permits free rotation of the first drum 104 and the second drum 100 with respect to the drive shaft 102 to provide proper deployment length for the line 108. Each of the detachable components 100 and the corresponding spools 200, 202, may be individually adjusted by disengagement of clutch 106 to provide a desired length of line 108. The disengagement of the clutch 106 permits the first drum 104 to turn independently of drive shaft 102 and permits individual alignment of the line 108 and barrier 110. Alignment is desirable during assembly of the barrier 110 and retraction system, wherein sizing of the components may be dependent, for example, on stage heights or barrier system mounting locations. In addition, newly installed components, including replacement barriers or replacement second drums may be quickly and easily configured to the height required for the particular assembly of the barrier and retraction system.

Retraction of the barrier 110 is provided when line 108 is drawn onto the first spool 200 and second spool 202 within the detachable second drum 100. The first drum 104 imparts rotation on second gear 112 via first gear 111, which in turn rotates the first and second spools 200 and 202 and facilitates the retraction of line 108. First and second spools 200 and 202 are structures that are capable of storing or deploying line 108 in response to rotational motion. The geometry of the first and second spools 200 and 202 may include any suitable geometry that is capable of receiving line 108 and deploying line 108, including, but not limited to cylindrical or elliptical bodies. First and second spools 200 and 202 may also include additional guides or structures for aligning or reducing tangling of lines 108 to facilitate reliable retraction and deployment of line 108. To deploy the barrier 110, the first drum 104 is rotated or allowed to rotate in the opposite rotational direction used to retract barrier 110, wherein the first spool 200 and the second spool 202 rotate in a manner that extends the length of the line 108 around and/or attached to barrier 110. While FIG. 2 shows first and second spools 200 and 202, the present invention may utilize one or more than two spools to retract or deploy line 108. The use of two or more spools permits the line 108 to be drawn in and deployed at a greater speed, due to a plurality of spools each drawing in line 108 or deploying line 108 at a rate corresponding to the rate of rotation of the drive shaft 102, as translated through the gearing arrangement between first drum 104 and second drum 100. In addition, the spools may configured with gearing or other similar arrangements to increase or decrease the rate of retraction or deployment of line 108 with respect to second gear 112 and/or increase or decrease the rotational force required to retract or deploy line 108.

In addition to the above features, the second gear 112 may also have locking device 114, such as a pawl, which selectively engages the second gear 112 and permits holding of the line 108 (i.e., holding the lower edge of barrier 110) in a given location without additional stress of the drive shaft 102 or the motor attached to the drive shaft 102.

Figure 3:
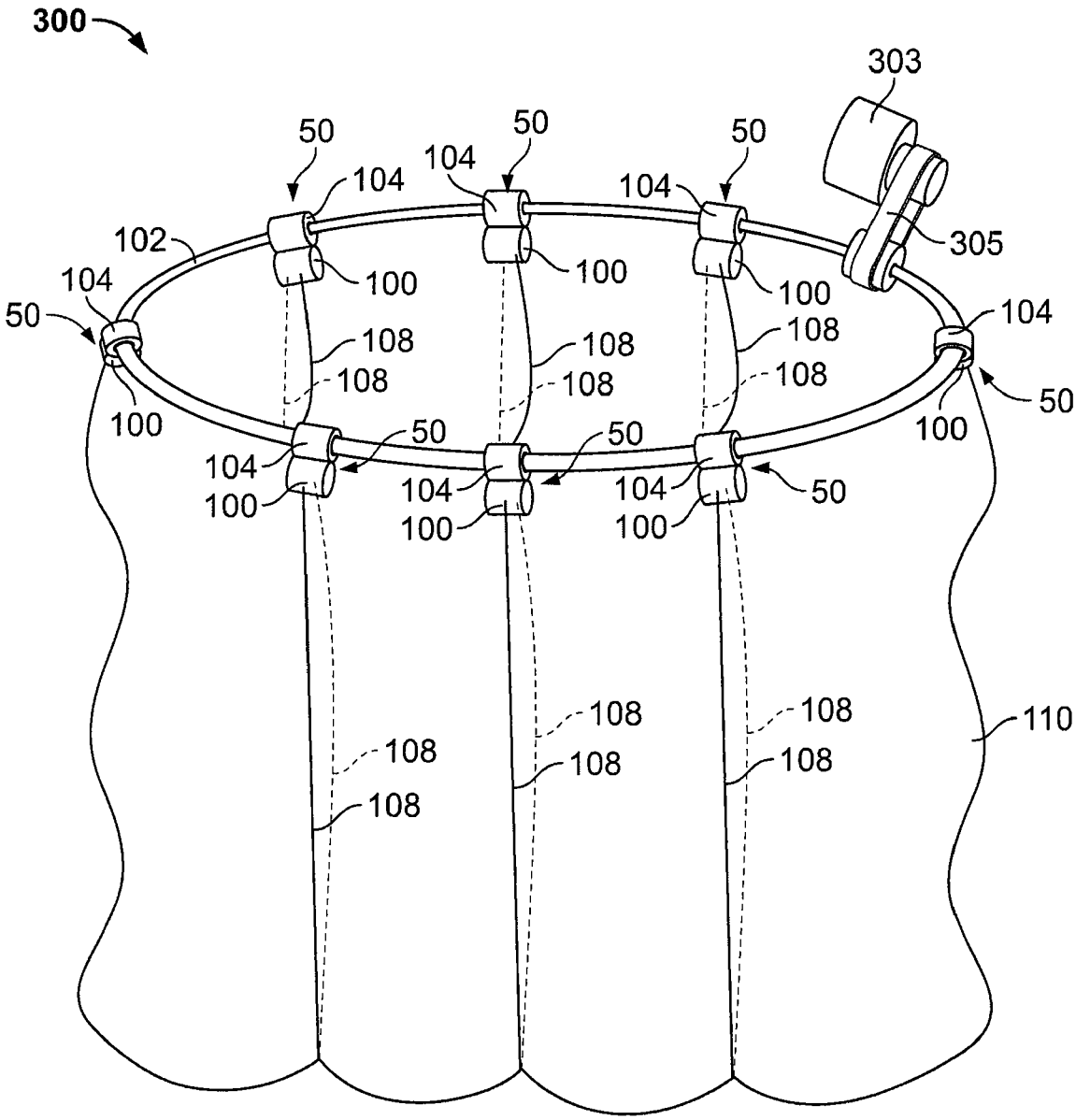
FIG. 3 shows a perspective elevational view of a barrier retraction system according to another embodiment of the present invention.
Figure 4:
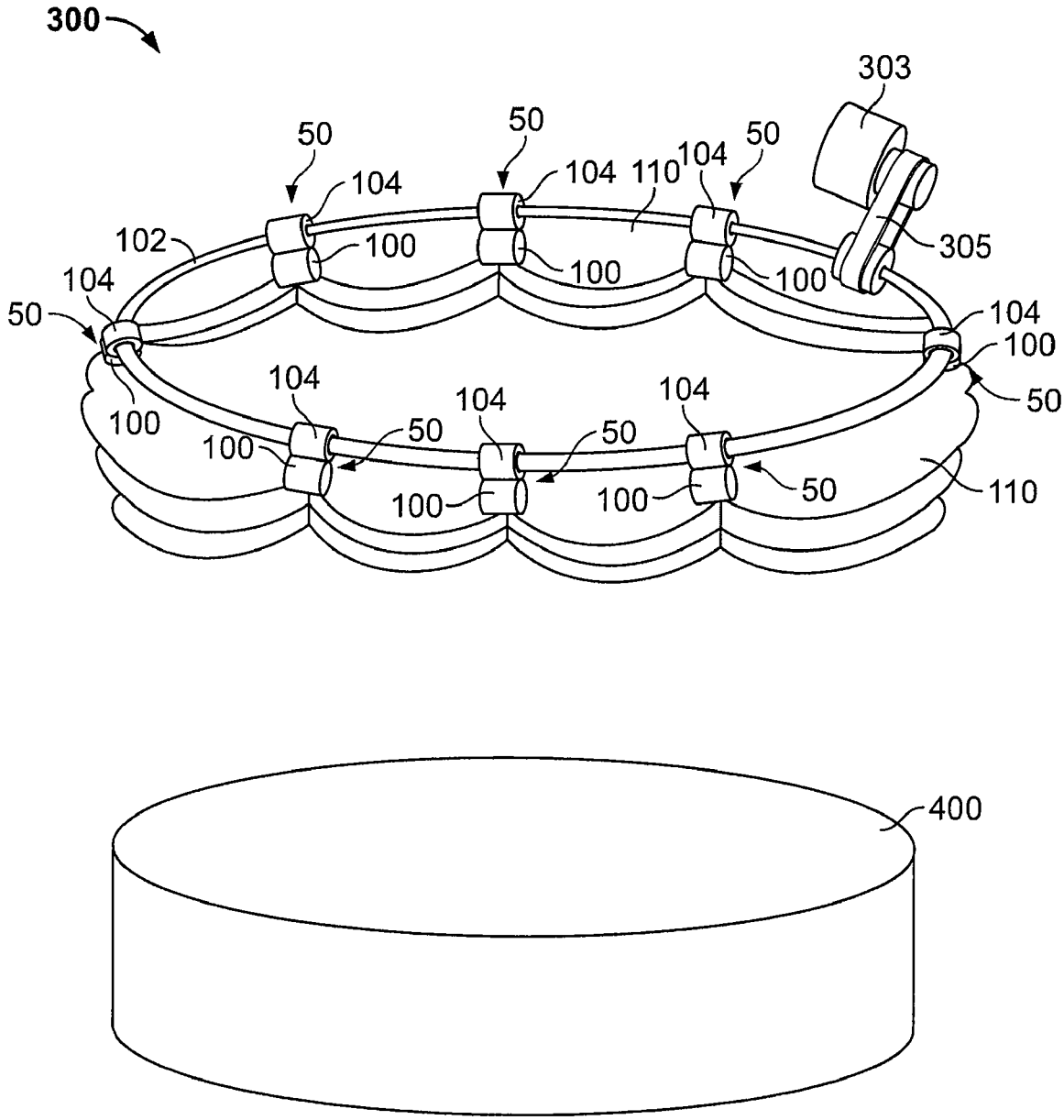
FIG. 4 shows the barrier retraction system of FIG. 3 in a retracted position.

FIGS. 3 and 4 illustrate operation of a barrier retraction system 300 according to an embodiment of the present invention. FIG. 3 illustrates a plurality of barrier retraction devices 50 arranged on a drive shaft 102 with a barrier 110 in a deployed position. The drive shaft 102 is arranged into a circular geometry. The present invention is not limited to the geometry of the drive shaft 102 shown and may include any geometry including, but not limited to, linear, oval, square and/or rectangular arrangements of drive shaft 102. Drive shaft 102 having curved geometries or corners may be fabricated from a flexible material that is capable of bending into the desired geometry or may be fabricated into segments coupled through universal or similar joints. The barrier retraction system 300 includes a driver 303 and drive mechanism 305 connecting the driver 303 to the drive shaft 102. The driver 303 is preferably a motor or similar device configured with the drive mechanism 305 to rotate the drive shaft 102 in one or each rotational direction. While the above has been shown and described with respect to a driver 303 and drive mechanism 305, the drive shaft 102 may be rotated by hand or by manual device. As discussed above with respect to FIGS. 1 and 2, barrier retraction devices 50 are configured to increase or decrease the length of line 108 adjacent or attached to barrier 110 in response to rotation of drive shaft 102. As the length of line 108 is decreased, the barrier 110 is drawn in a direction toward barrier retraction device 50.

FIG. 4 shows the barrier 110 in a retracted position. In this embodiment of the invention, a stage 400 is exposed once the barrier 110 is retracted. The plurality of barrier retraction device 50 are preferably individually configured to draw the line 108 at substantially the same rate, deploy to substantially the same length and retract to substantially the same position, allowing the retracted barrier to provide the desired retraction and deployment of barrier 110. The lengths of line 108 for deployment and retraction desirable for a particular application is dependent upon a variety of factors, including but not limited to, the height of the stage or platform utilizing barrier 110, the height of the structure to which support frame 101 may be attached, desired retraction/deployment rate, the desired retraction pattern (i.e., scallop, festoon or other retraction pattern), and a variety of other factors relating to the particular venue of the theatrical or concert event. While the above has been described as symmetrical retraction and deployment, it may be desirable to configure the barrier retraction device 50 to provide asymmetrical deployment in order to provide the desired visual effect. During assembly of the barrier retraction system 300, the first drum 100 may be rotated in a manner to select the desired length of line 108 available for deployment of barrier 110. This sizing may be accomplished for each of the barrier retraction devices 50.

The barrier retraction system 300 according to one embodiment of the present invention portable. Portable, as utilized herein, means that the components are detachable into component units that are sized for storage and/or transport. In a preferred embodiment, the component units are configured to a size that fits within a conventional tractor trailer and/or the cargo hold of a 747, or similar aircraft and/or the cargo hold of a sea vessel. In addition, the components of barrier retraction system 300 may be arranged and/or discreetly labeled in order to provide quick and accurate assembly. For example, the barrier 110 is preferably detachable from second drum 100, and the second drum 100 is preferably detachable from first drum 104 and support frame 101. In addition, the frame 101, first drum 104, and the second drum 100 preferably disassemble into separate components that are sufficiently small to fit into the cargo hold of a tractor trailer and/or cargo aircraft.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A portable barrier retraction device comprising:

a first drum;

a rotatable shaft in selective rotational communication with the first drum;

a clutch configured to disengage the first drum from the rotatable shaft;

a detachable rotatable second drum in rotational communication with the first drum, the second drum comprising a first spool configured to independently retract or deploy a line in response to rotation of the second drum and a second spool configured to independently retract or deploy a second line in response to rotation of the second drum;

wherein the shaft selectively imparts rotation to the second drum by selectively imparting rotation to the first drum.

2. The device of claim 1, wherein the lines are retractable in a manner that forms a festoon pattern in the barrier during retraction.

3. The device of claim 2, wherein the barrier is a theatrical cuff am.

4. The device of claim 1, wherein the barrier retraction device provides asymmetrical deployment of the barrier.

5. The device of claim 1, wherein the rate of retraction or deployment may be increased or decreased.

6. The device of claim 1, wherein the second drum is attached to the barrier.

7. The device of claim 1, wherein the second drum further includes a locking device, wherein the locking device selectively prevents rotation of the second drum and the spool.

8. The device of claim 1, wherein the first drum and the second drum comprise a geared arrangement.

9. A portable barrier retraction system comprising:

a barrier having at least one line disposed adjacent thereto, at least one barrier retraction device having:

a first drum;

a rotatable shaft in selective rotational communication with the first drum;

a clutch configured to disengage the first drum from the rotatable shaft;

a detachable rotatable second drum in rotational communication with the first drum, the second drum comprising a first spool that independently retracts or deploys a line in response to rotation of the second drum and a second spool configured to independently retract or deploy a second line in response to rotation of the second drum;

wherein the shaft selectively imparts rotation to the second drum by selectively imparting rotation to the first drum; and a support frame into which the first drum and second drum are independently mounted.

10. The system of claim 9, wherein the lines attach to the barrier in a location along the surface of the barrier that permits retraction of the barrier.

11. The system of claim 9, wherein the lines are retractable in a manner that forms a festoon pattern in the barrier during retraction.

12. The system of claim 11, wherein the barrier is a theatrical curtain.

13. The system of claim 9, wherein the barrier retraction device provides asymmetrical deployment of the barrier.

14. The system of claim 9, wherein the rate of retraction or deployment may be increased or decreased.

15. The system of claim 9, wherein the first drum and the second drum comprise a geared arrangement.

16. The system of claim 9, wherein the second drum is attached to the barrier.

17. The system of claim 9, wherein the shaft is arranged in a circular geometry.

18. The system of claim 9, wherein the shaft comprises a plurality of segments rotatably coupled together.

19. The system of claim 9, further comprising a driver configured to rotate the shaft.

20. The system of claim 9, wherein the barrier, the at least one barrier retraction device and the frame disassemble into components that are capable of being stored in the cargo hold of an aircraft.

* * * * *

UNITED STATES PATENT AND TRADEMARK OFFICE

CERTIFICATE OF CORRECTION

PATENT NO. : 7,703,499 B2
APPLICATION NO. : 11/677804
DATED : April 27, 2010
INVENTOR(S) : Tait et al.

It is certified that error appears in the above-identified patent and that said Letters Patent is hereby corrected as shown below:

Col. 5, Line 28, "747" should not be bold.

Claim 3 in Col. 6, Line 7, "theatrical cuff am" should read --theatrical curtain--.

Signed and Sealed this

Seventeenth Day of August, 2010

David J. Kappos

David J. Kappos
*Director of the United States Patent and Trademark Office*